US005615958A

United States Patent [19]

Furrow et al.

[11] Patent Number: 5,615,958

[45] Date of Patent: Apr. 1, 1997

[54] OSCILLATORY RIBBON CARTRIDGE FOR A PRINTER

[75] Inventors: Edward D. Furrow; Paul Snyder, both of Waynesboro, Va.

[73] Assignee: Genicom Corporation, Waynesboro, Va.

[21] Appl. No.: 578,067

[22] Filed: Dec. 20, 1995

[51] Int. Cl.[6] ..... B41J 32/02

[52] U.S. Cl. ..... 400/208; 400/211

[58] Field of Search ..... 400/208, 211

[56] References Cited

U.S. PATENT DOCUMENTS

| | | | |
|---|---|---|---|
| 4,368,993 | 1/1983 | Brass et al. | 400/216.2 |
| 4,469,459 | 9/1984 | Trezise et al. | 400/216.1 |
| 4,630,948 | 12/1986 | Karns | 400/208 |
| 4,820,068 | 4/1989 | Mitcham | 400/216.1 |
| 4,968,162 | 11/1990 | Iwai et al. | 400/232 |
| 5,026,182 | 6/1991 | Suzuki | 400/208 |

FOREIGN PATENT DOCUMENTS

| | | | |
|---|---|---|---|
| 71690 | 4/1987 | Japan | 400/211 |
| 402227279 | 9/1990 | Japan | 400/211 |

OTHER PUBLICATIONS

Purcell et al., "Unique Cam Arrangement for Printer Ribbon Feed Mechanism," IBM Technical Disclosure Bulletin, vol. 26, No. 1, pp. 67–68 Jun. 1983.

*Primary Examiner*—Edgar S. Burr
*Assistant Examiner*—Daniel J. Colilla
*Attorney, Agent, or Firm*—Nixon & Vanderhye P.C.

[57] ABSTRACT

A printer cartridge includes exit and entrance arms for receiving and exiting ribbon from the cartridge in response to a drive mechanism whereby the ribbon passes from the exit arm to an entrance arm past a printhead. An oscillator is coupled to the ribbon drive mechanism and includes a cam carried by the cartridge engaging a cam lever pivotally carried by the cartridge. The lever bears against a printer support when the cartridge is disposed in the printer. When the drive mechanism advances the ribbon, the oscillator is also driven to pivot the cartridge about a longitudinal axis, thereby gradually locating upper and lower portions of the ribbon in registration with the printhead as the ribbon advances.

17 Claims, 5 Drawing Sheets

OSCILLATORY RIBBON CARTRIDGE FOR A PRINTER

TECHNICAL FIELD

The present invention relates to ribbon cartridges containing a print ribbon for use in printers and particularly relates to a system for oscillating the ribbon cartridge about a longitudinal axis whereby maximum utilization of the ribbon surface during printing is achieved.

BACKGROUND

In most commercial high-speed printers, ribbon cartridges are consumable items discarded after use and replaced with fresh cartridges. To extend the life of the ribbon within the cartridge, various devices have been employed. For example, cartridges often contain re-inkers. Also, mobius loops are used to invert the ribbon (fabric) to utilize the maximum amount of surface area and both sides of the ribbon whereby use of available ink is optimized. However, even with these devices, such extended use cartridges still have only marginally extended useful lives. There are also a number of devices for shifting the ribbon on command upwardly or downwardly into alignment with the operative face of a printhead. These are principally used for multi-colored ribbons, for example, where two or more bands of different color inks are on the ribbon and it is desirable to print a selected color on the substrate. Shifters then shift the ribbon into alignment with the printhead so that the desired print color may be achieved on the substrate. Shifters may also be used to shift a one-color ribbon to extend the life of the ribbon by using a larger area of the fabric surface. The shifters are typically connected and driven by printer logic which controls the up-and-down motion of the ribbon while the printhead traverses horizontally. To applicant's knowledge, there has not previously been a printer cartridge mounted in the printer for oscillatory movement during printing by a mechanism carried by the cartridge itself whereby increased percentage of the area of the ribbon is actually used.

DISCLOSURE OF THE INVENTION

According to the present invention, there is provided a ribbon cartridge mounted in a printer for oscillatory movement about an elongated axis and coupled to the ribbon drive mechanism such that, upon advance of the ribbon, and/or the drive of the drive gear/shaft, the cartridge oscillates to present different elevations of the ribbon width to the printhead for printing whereby the life of the ribbon is greatly extended by actual use of a very high percentage of the ribbon face. To accomplish the foregoing, there is provided a ribbon cartridge housing having top, bottom and side walls, and a pair of arms projecting to one side of the housing adjacent opposite ends thereof, respectively, serving as exit and entrance portions for the ribbon disposed within the housing. The cartridge is mounted on the printer for pivotal, i.e., oscillatory movement about a longitudinal axis. A drive mechanism within the housing coupled to a drive gear on the printer advances the ribbon from the exit arm past a printhead and into the entrance arm of the cartridge for reuse. The drive mechanism includes a pair of rollers, through the nip of which the print ribbon is passed.

To oscillate the cartridge about its axis, an oscillator is coupled by a plurality of gears to the drive mechanism. The oscillator includes a cam rotatable by the drive mechanism through a series of reducing gears. The cam includes an annular cam groove inclined to the axis of rotation of the cam and engages a cam follower. The cam follower includes a lever pivotally mounted to the underside of the cartridge for bearing engagement on a support or surface of the printer. The axis of rotation of the coupling between the cam follower and the cartridge is preferably spaced from and parallel to the longitudinal oscillatory axis of the cartridge relative to the printer. The lever includes a pair of flat surfaces which engage a flat surface on the printer, preferably a mount for the cartridge, such that, upon rotation of the cam, with the annular groove in engagement with the fixed cam follower, the cartridge is oscillated or pivoted about its longitudinal oscillatory axis. Thus, as the drive mechanism is driven from the printer to advance the print ribbon, the drive mechanism also drives the oscillator to continuously oscillate the cartridge about the longitudinal axis. The oscillatory movement of the cartridge continuously displaces the print ribbon in a vertical direction such that different portions of the print ribbon are engaged between the printhead and the substrate as the ribbon advances during printing. Consequently, a complete oscillation of the cartridge may occur for a predetermined advance of the ribbon, for example, on the order of 28–30 inches of ribbon. The oscillatory movement is essentially random with respect to the ribbon such that repeat movements of the ribbon past the printhead will generally not repeat with like elevations of the ribbon in exact registration with the printhead. For this example, approximately twelve turns of the ribbon drive are required for one cartridge oscillation.

To further extend the life of the ribbon, a mobius wire is preferably provided within the cartridge housing for inverting the ribbon and reversing the print face of the ribbon relative to the substrate for each pass of the ribbon through the cartridge. This, in conjunction with the oscillatory movement of the cartridge relative to the printer, extends the life of the ribbon.

In a preferred embodiment according to the present invention, there is provided a ribbon cartridge having a print ribbon for use with a printer having a printhead comprising a cartridge housing having top, bottom and side walls, a pair of arms projecting to one side of the housing adjacent opposite ends thereof, respectively, and connections for pivotally mounting the cartridge to the printer for oscillation about an axis, the walls in part defining a storage chamber for receiving and storing the print ribbon, the arms defining ribbon entrance and exit paths, respectively, for receiving the ribbon for delivery to the storage chamber and supplying the ribbon from the storage chamber for spanning between the arms in opposition to the printhead, a drive mechanism within the housing for advancing the print ribbon from the exit arm across the span between the arms and into the entrance arm and an oscillator carried by the housing and engageable with the printer for oscillating the cartridge about the axis as the ribbon advances, thereby displacing the ribbon between the arms in a generally vertical direction relative to the printhead.

In a further preferred embodiment according to the present invention, there is provided a ribbon cartridge for use with a printer comprising a ribbon cartridge housing having spaced ribbon exit and entrance portions and bearing surfaces for mounting the cartridge for oscillatory movement about an axis, a ribbon disposed in the housing, a drive mechanism for advancing ribbon from the ribbon cartridge exit portion to the ribbon cartridge entrance portion and an oscillator carried by the housing for oscillating the housing about the axis.

In a still further preferred embodiment according to the present invention, there is provided an oscillator cooperable between a ribbon cartridge and a printer to oscillate the ribbon cartridge about an axis relative to the printer, the cartridge having a ribbon drive, comprising a cam for attachment to the ribbon drive of the cartridge and rotatable in response thereto, the cam having a cam surface rotatable in a plane eccentric to a plane normal to the axis of rotation of the cam, a cam follower in engagement with the cam surface and having a mounting for pivotally connecting with the cartridge, the cam follower including at least one stabilizing surface for engagement with the printer whereby, upon rotation of the cam, the cartridge is enabled for oscillating motion relative to the printer.

In a still further preferred embodiment according to the present invention, there is provided a method of operating a printer having a printhead and a cartridge received in the printer, the cartridge including a print ribbon, comprising the steps of mounting the cartridge in the printer for oscillatory movement about an axis and relative to the printer, advancing the ribbon past the printhead and oscillating the cartridge about the axis when advancing the ribbon past the printhead.

Accordingly, it is a primary object of the present invention to provide a novel and improved ribbon cartridge for a printer wherein the cartridge is oscillated about a longitudinal axis such that the life of the print ribbon is extended.

BEST MODE FOR CARRYING OUT THE INVENTION

Figure 1:
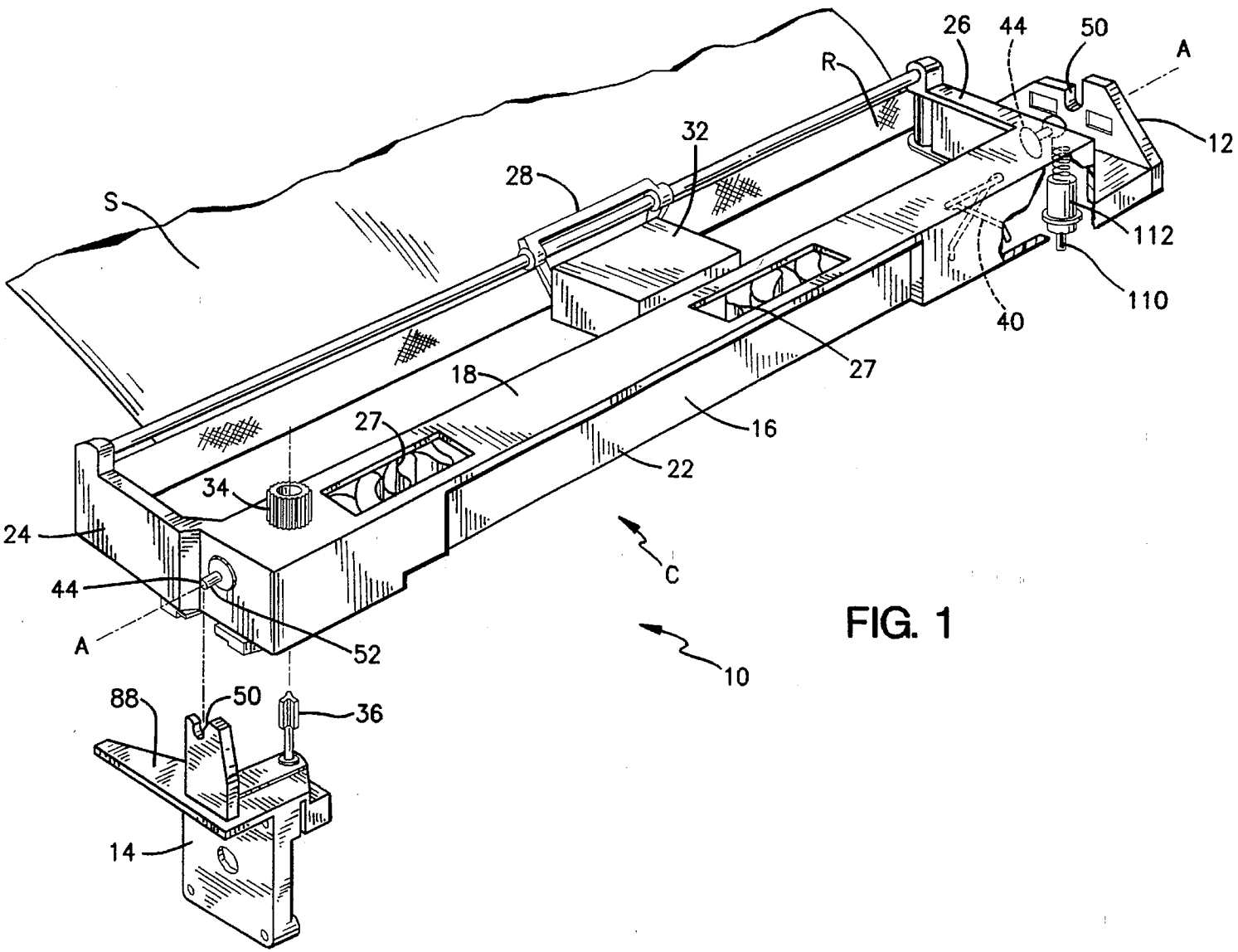
FIG. 1 is a fragmentary perspective view of a mount for a ribbon cartridge and a print ribbon cartridge according to the present invention.

Referring now to the drawings, and particularly to FIG. 1, there is illustrated a printer, generally designated 10, only a portion of which is illustrated, including mounts 12 and 14 secured to opposite sides of the frame of the printer. A ribbon cartridge, generally designated C, constructed in accordance with the present invention, is mounted in the printer 10 and particularly adjacent the print deck 12. The cartridge C includes an elongated housing 16 having top, bottom and side walls 18, 20 and 22 and a pair of arms 24 and 26 projecting to one side of the housing adjacent opposite ends thereof. An endless ribbon R is disposed within the housing, i.e., stored by randomly filling a storage chamber 27 within the housing, and is coupled to a ribbon guide 28 mounted on a ribbon guide bar 30 extending between the ends of arms 24 and 26. The ribbon guide 28 locates the ribbon R in registration with a printhead 32, it being appreciated that the printhead traverses back and forth along the length of the substrate S under control of the printer to effect printing on the substrate. The ribbon may be endless, e.g., seamed or welded, or can be a discrete length.

The ribbon R is driven by a drive mechanism essentially consisting of rollers having gear teeth defining a nip therebetween through which the ribbon passes. The drive mechanism includes a drive roller 34 which is releasably engageable with a rotatable ribbon drive 36 under control of the printer 10. It will be appreciated that the ribbon advances when the printer is in an actual printing mode, not during standby or printer-off modes. Additionally, the print ribbon is preferably continuously advanced during movement of the printhead in a direction opposite to the direction of advancement of the ribbon. The ribbon remains stationary during movement of the printhead in the same direction of advancement as the ribbon. Thus, the ribbon drive mechanism is actuated only during movement of the printhead in a direction opposite to the direction of movement of the ribbon.

When the cartridge C is disposed in the printer, the ribbon drive 36 is received in an opening 38 (FIG. 2) through the underside 20 of the cartridge, the ribbon drive 36 having a contoured surface for engaging a correspondingly contoured surface within the drive roller 34. The drive roller 34 has a portion which projects above the cartridge as illustrated in FIG. 1 for manual rotation of the drive roller to take up slack in the ribbon if necessary. As illustrated in FIG. 1, the ribbon is randomly disposed within the cartridge housing and extends through a mobius 40 en route to the exit arm 26 for movement through the guide 28 past the printhead 32 and for reentry into the housing via the entrance arm 24.

The cartridge has connections 44 at its opposite ends for pivotally mounting the cartridge to the printer for oscillatory movement about a longitudinal axis indicated by the dashed lines A—A. A number of different methods may be employed to engage the cartridge in the printer for pivotal movement. For example, the mounts 12 and 14 at respective opposite ends of the printhead each include an upstanding support having a notch 50 for receiving the projecting axles 52 of the connections at the opposite ends of the cartridge.

Figure 2:
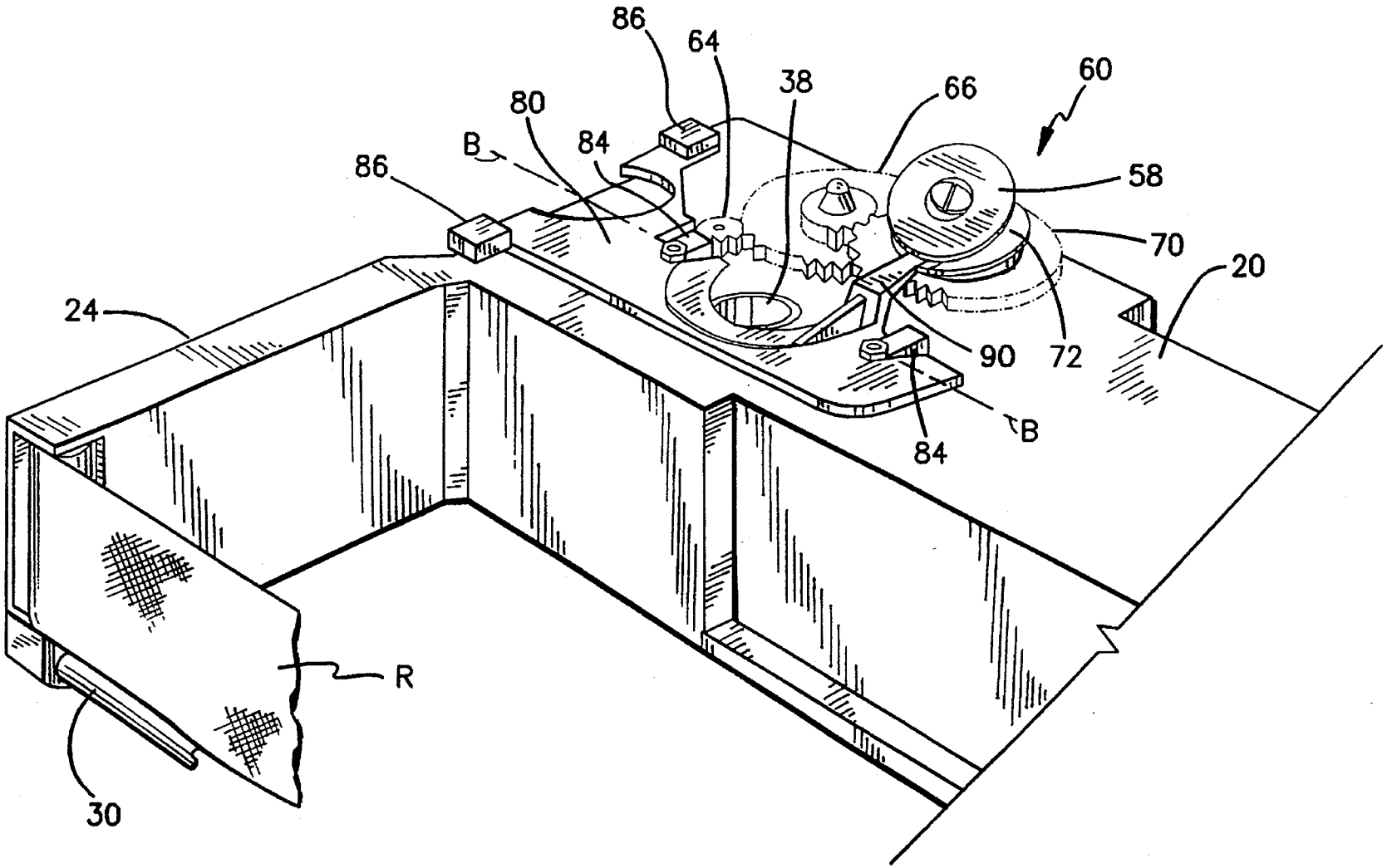
FIG. 2 is an enlarged fragmentary perspective view of the underside of one end of the printer cartridge illustrated in FIG. 1 illustrating a portion of the oscillator for oscillating the cartridge about a longitudinal axis.
Figure 3:
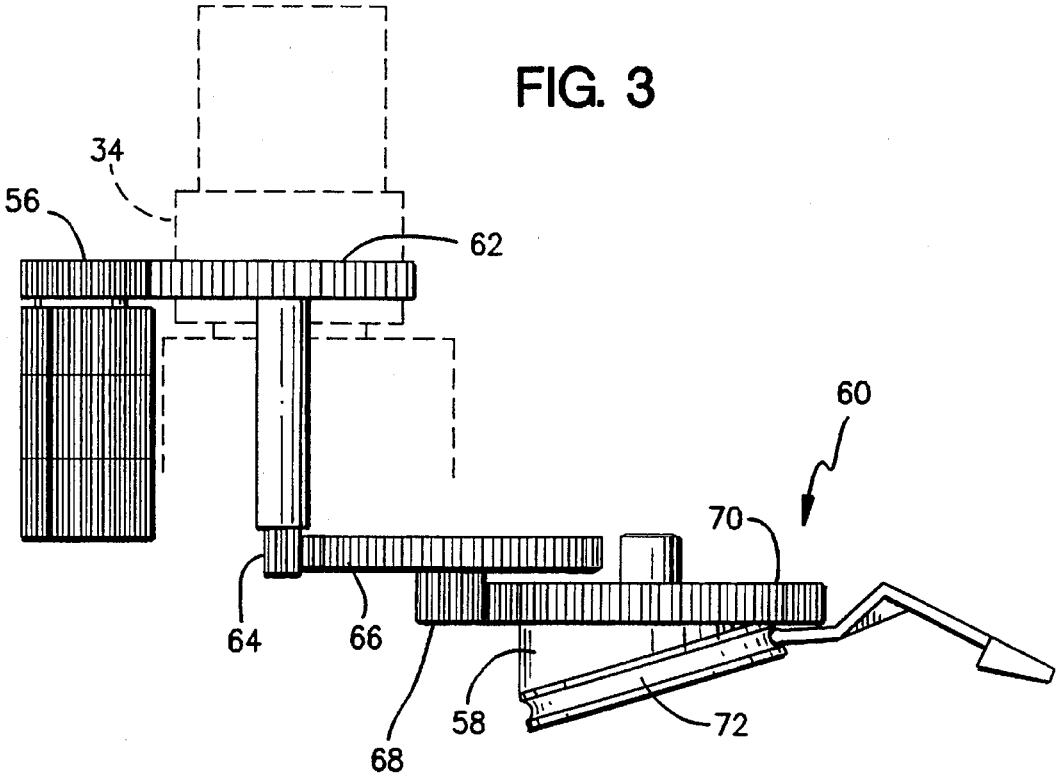
FIG. 3 is an enlarged fragmentary elevational view illustrating the coupling between the print ribbon drive mechanism and the oscillator according to the present invention.

Referring now to FIGS. 2 and 3, an oscillator, generally designated 60, is carried by the cartridge housing for oscillating the cartridge about the axis A—A as the ribbon R is advanced past the printhead 32. To accomplish this, the oscillator 60 includes a series of gears, as illustrated in FIG. 3, between the idler roller 56, which defines the nip with the drive roller 34, and a rotatable cam 58. Thus, as illustrated in FIG. 3, gear 56 is driven by the drive roller 34 and is coupled to a gear 62. A pinion 64 carried by gear 62 drives a gear 66, the pinion 68 of which drives a gear 70 mounting the cam 58. The cam includes an annular groove 72 disposed in a circular plane forming an angle other than a right angle, i.e., an acute angle, with the axis of rotation of the gear 70 and cam 58. The gears 64, 66, 68 and 70, as well as the rotatable cam 58, project from the underside of the housing, as illustrated in FIG. 2, at one end of the cartridge.

Figure 5:
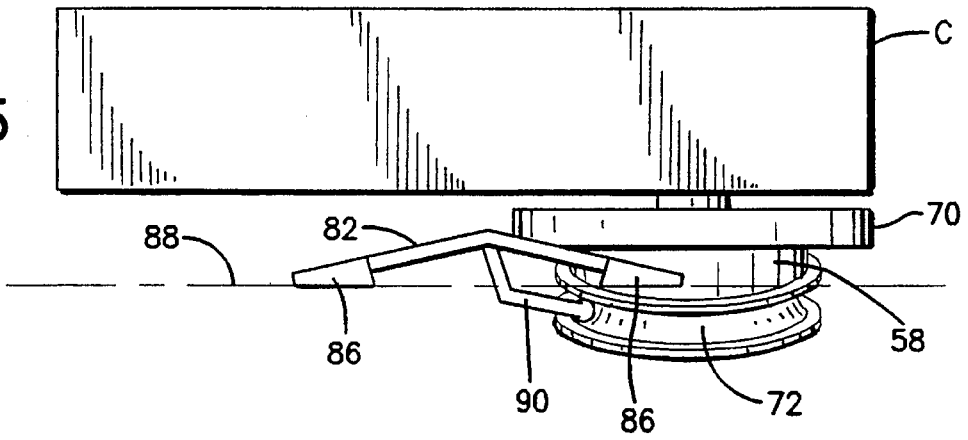
FIGS. 5, 6 and 7 are exaggerated schematic illustrations of the oscillatory motion of the cartridge about a longitudinal axis and relative to a horizontal plane through the printer.
Figure 6:
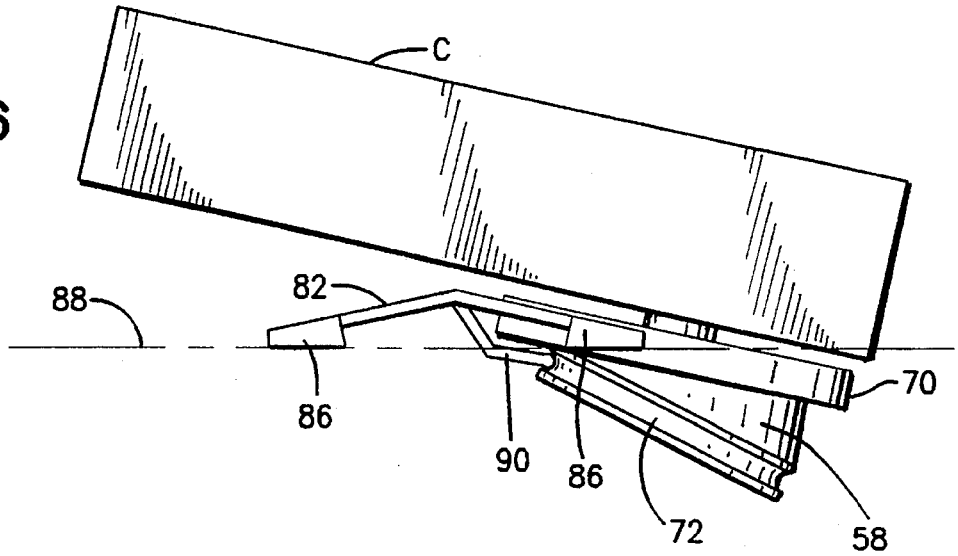
Figure 7:
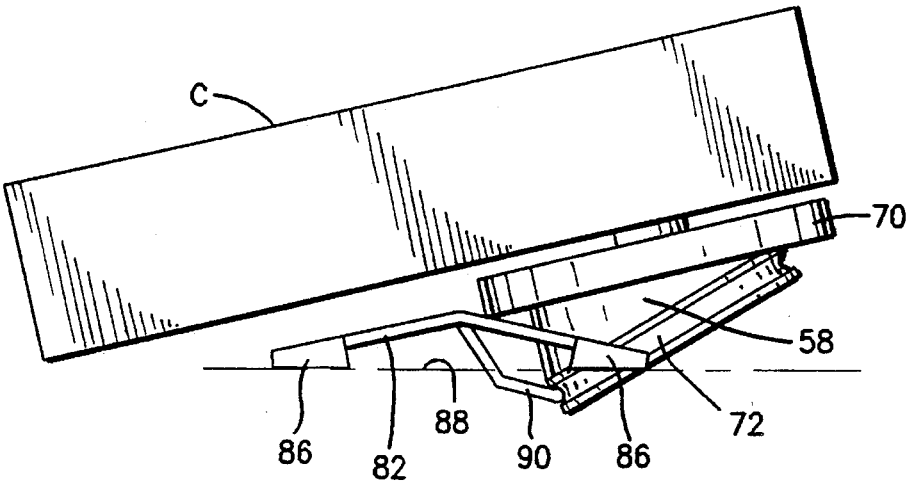

Also illustrated in FIGS. 2 and 3 is a cam follower 80. Cam follower 80 includes an angled plate 82 (FIGS. 5–7) pivotally mounted to the underside of the cartridge by pins, not shown, extending longitudinally into hubs 84 formed on the underside of the cartridge. Thus, the cam follower 80 is mounted for pivotal movement about an axis B—B as illustrated in FIG. 2. Axis B—B is parallel to and spaced from the axis A—A of rotation of the cartridge relative to the printer. Cam follower 80 also has two projecting legs 86 having flat undersurfaces for bearing engagement against a generally horizontal upper surface 88 of the mount 14 at one end of the cartridge. The surface 88 is represented in FIGS. 5–7 by the dot-dashed line. Cam follower 80 also includes a finger 90 which projects therefrom into the annular groove 72 of cam 58. Thus, the end of the finger 90 follows the groove 72 as the cam 58 rotates.

Figure 4:
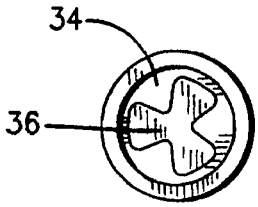
FIG. 4 is an enlarged view illustrating the coupling between the ribbon drive of the printer and the drive mechanism of the cartridge.

When the cartridge is disposed in the printer, the end connections 52 are carried in the notches 50 such that the cartridge is mounted for pivotal movement about the axis A—A. Additionally, the ribbon drive 36 is received in the drive gear 34 and engages the correspondingly-shaped interior surface of the drive gear 34 as illustrated in FIG. 4. Consequently, upon movement of the printhead in a direction opposite to the direction of advancement of the ribbon and consequent rotation of the ribbon drive 36 by operation of the printer, the drive pin 34 rotates to advance the ribbon R past the printhead 32 (which is likewise moving but in the opposite direction). More particularly, the drive rollers draw the ribbon from the housing by way of exit arm 26 past the printhead 32 and back into the housing via the entrance arm 24. Additionally, as the drive gear 34 rotates, the gear train 56, 62, 64, 66, 68 and 70 cause the cam 58 to rotate very slowly in relation to the rotation of the drive rollers. It will be appreciated that the cam follower 80 rests on the upper surface 88 of the mount 14. That is, the surfaces 86 of cam follower 80 as illustrated in FIGS. 5–7 rest on surface 88 maintaining the cam finger 90 in a predetermined position in the annular groove 72 of cam 58. Consequently, upon rotation of cam 58 and following engagement of the finger 90 in the groove 72, the cartridge is continuously controllably pivoted and oscillated about the axis A—A by the cooperation of the rotatable cam 58 and finger 90. For example, with the legs 86 engaging the surface 88 as illustrated in FIG. 5 and the annular groove 72 in a neutral position between its high and low extremes, the cartridge C rests in a substantially horizontal position with the ribbon in opposition to the printhead with printing occurring substantially medially of the height of the ribbon. Upon advance of the ribbon such that the low point of the annular groove 72 engages finger 90, the cartridge is pivoted in an upward direction as illustrated in FIG. 6, thus registering the lower portions of the ribbon with the printhead 32. Upon a complete rotation of 180° such that the high point of the annular groove 72 engages the finger 90, the cartridge is pivoted in a downward direction, as illustrated in FIG. 7, to register an upper portion of the ribbon with the printhead. Thus, continuous advancement of the ribbon also continuously and slowly oscillates the cartridge about the axis A—A, thereby presenting elevationally different portions of the ribbon to the printhead and substrate as the ribbon advances. When the printhead reverses direction and moves in the same direction as the ribbon was previously moving, the printer causes the drive pin 34 to stop, thereby maintaining the print ribbon stationary and precluding oscillatory motion of the cartridge whereby the printhead prints along a stationary ribbon. When the printhead reverses direction, the printer rotates drive pin 34 to once again advance the ribbon and oscillate the cartridge.

Figure 8:
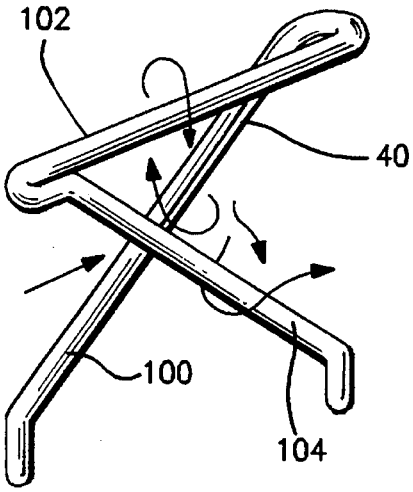
FIG. 8 is an enlarged perspective view of a mobius wire disposed within the cartridge for inverting the ribbon.

To assist in extending the usable life of the ribbon, the mobius 40 is disposed adjacent the exit end of the cartridge, as illustrated in FIG. 1. The mobius 40 essentially comprises a wire bent into a configuration specifically illustrated in FIG. 8 to invert the ribbon as the ribbon passes the mobius and to reverse the face of the ribbon for presentation to the printhead. The wire includes a first angled portion 100, an upper base portion 102 and a second angled portion 104. First and second angled portions 100 and 104, respectively, lie on opposite sides of the base portion 102 and are essentially diagonally disposed relative to the direction of travel of the ribbon through the cartridge. The ribbon enters the mobius 40 along the back side of the first diagonal portion 100 and wraps around diagonal portion 100, extending upwardly to pass over the base portion 102. In passing over the base portion 102, the ribbon passes along the inside of diagonal portion 104 and passes around diagonal portion 104 for movement toward the exit arm 26 of the cartridge C. With this wrapping of the ribbon about the various portions of the mobius 40, the ribbon is inverted and its face is reversed.

Figure 10:
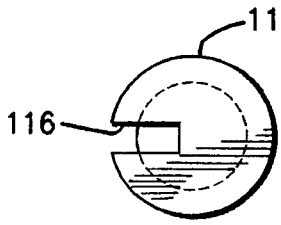
FIG. 10 is a top plan view thereof.
Figure 9:
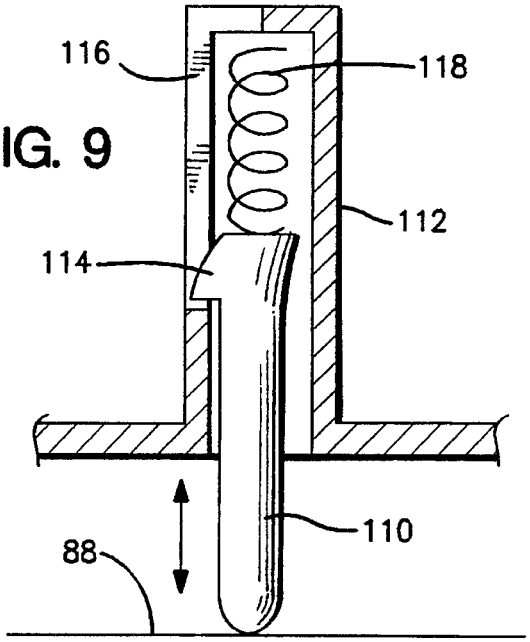
FIG. 9 is an enlarged fragmentary cross-sectional view of a pin engaging between the cartridge and the print deck for biasing the cartridge into a predetermined position.

Referring to FIGS. 9 and 10, a pin 110 is disposed in a housing 112 formed along the inside of the cartridge C adjacent the exit end of the cartridge. The pin is retained in housing 112 by a projection 114 engaging in a slot 116 formed in housing 112. A spring 118 biases the pin outwardly into engagement with a printer surface. Consequently, the opposite end of the cartridge from the oscillator controls the slack and backlash in the gears of the oscillator and maintains the cartridge biased in a down direction on the printer. This reduces the dwell time when the oscillator changes directions and minimizes or eliminates excess wear along the ribbon at the upper and lower regions of the oscillatory excursion.

Figure 11A:
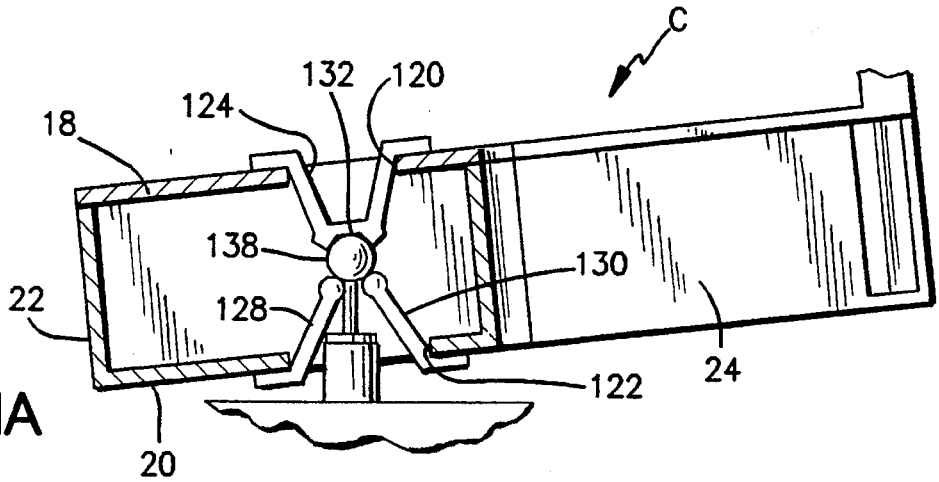
FIGS. 11A–11C are fragmentary cross-sectional views through an end of a cartridge illustrating a further form of pivotal mount for the cartridge.
Figure 11B:
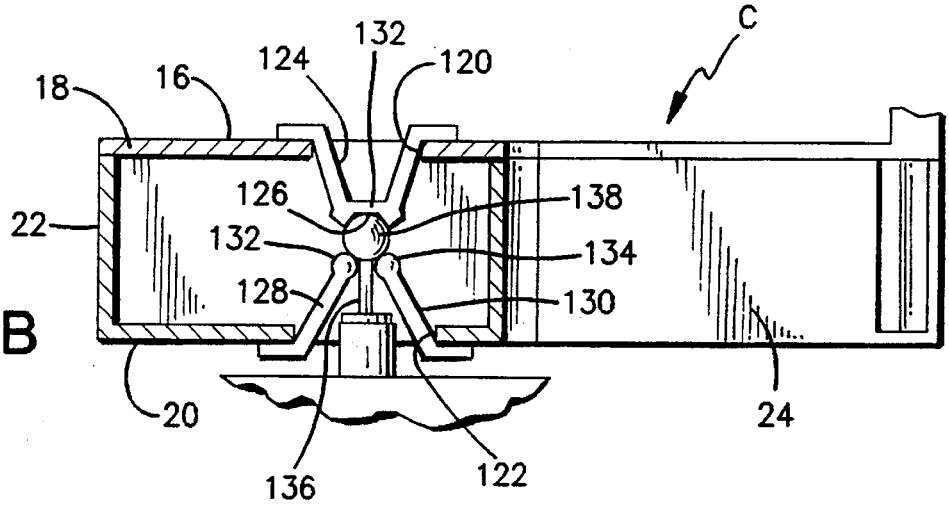
Figure 11C:
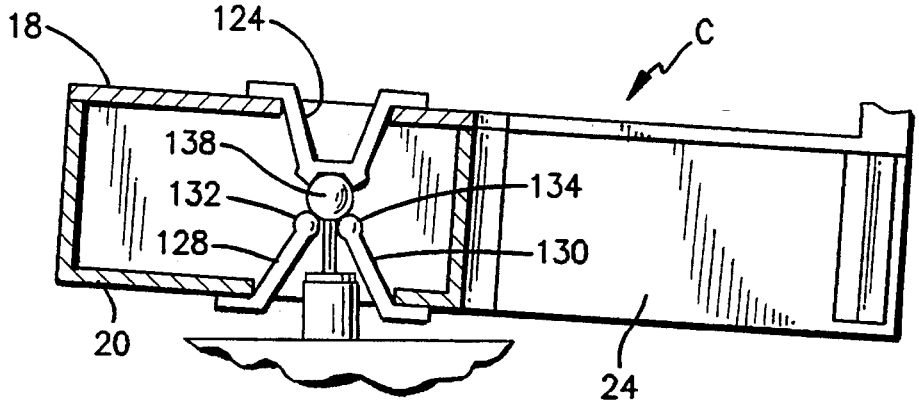

Referring now to the embodiment hereof illustrated in FIGS. 11A–11C, there is illustrated a modified form of the mounting for the cartridge in the printer. At each of the opposite ends of cartridge C, there are provided slots 120 and 122 through the upper and lower walls 18 and 20, respectively, of the cartridge. The upper slot 120 receives a generally U-shaped bracket 124 terminating at its lower end in a bearing surface 126. The lower slot 122 includes a pair of brackets 128 and 130 terminating at their upper ends in bearing heads 132 and 134, respectively. A third bracket, not shown, extends upwardly from the bottom slot 122 and engages the base 132 of the bracket 124.

The end mounts, instead of providing notched surfaces, for example, 50, comprise upstanding pins 136 each terminating at their upper ends in a ball 138. Thus, the cartridge C can be seated on the mounts by passing the balls 138 upwardly through the slots 122 past the heads 132 and 134 for engagement against the bearing surface 126 of upper bracket 124. The ball 138 is thus confined between the upper bracket 124, the side brackets 128 and 130, and a bracket not shown, preventing endwise displacement of the cartridge relative to the ball mounts sufficiently to unseat the ball from the seat 126. Thus, the spring fingers of brackets 128 and 130 maintain the ball 138 in engagement along the bearing surface 126, enabling cartridge C to pivot or oscillate about the axis A—A under control of the oscillator mechanism previously described.

It will be appreciated that the present cartridge is particularly useful for a single-color ribbon. For example, an all-black ribbon, an all-red ribbon or any other single-color ribbon may be used whereby substantially the entirety of the surface area of the ribbon is used to print on the substrate. The cartridge may, however, also be used with multi-color ribbons. The cartridge is also constructed such that the oscillator mechanism is primarily carried by the cartridge. Accordingly, other types of cartridges containing multi-color ribbons may be used with the same printer. Thus, the oscillator is principally housed within the cartridge and only the lever reacts with the printer surface to provide a reaction force for pivoting the cartridge.

It will also be appreciated that the oscillating mechanism may be provided as a unit separate from the cartridge and detachably secured thereto. For example, the pivotal mounting of the plate to the cartridge may be provided by pins which clip onto hubs formed along the underside of the cartridge. The gear train between the drive pinion 64 and the cam may similarly be releasably detachably mounted on the cartridge by shafts engaging with clips along the underside of the mounting, enabling the gears for rotation. Alternatively, the gear train, cam and cam follower with the reaction surface may be provided as part of a separate housing releasably secured to the cartridge by appropriate clips.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ribbon cartridge having a print ribbon for use with a printer having a printhead comprising:

a cartridge housing having top, bottom and side walls, a pair of arms projecting to one side of said housing adjacent opposite ends thereof, respectively, and connections for pivotally mounting the cartridge to the printer for oscillation about an axis, said walls in part defining a storage chamber for receiving and storing the print ribbon, said arms defining ribbon entrance and exit paths, respectively, for receiving the ribbon for delivery to the storage chamber and supplying the ribbon from the storage chamber for spanning between said arms in opposition to the printhead;

a drive mechanism carried by said housing for advancing the print ribbon from the exit arm across the span between said arms and into the entrance arm; and an oscillator mounted on and carried by said housing and engageable with the printer for oscillating the cartridge about said axis as the ribbon advances, said oscillator including a cam coupled to said print ribbon drive mechanism and movable in response to actuation of said print ribbon drive mechanism and a cam follower movably carried by said cartridge housing in following engagement with said cam and engageable with the printer whereby movement of said cam and following engagement of said cam follower enables said cartridge to pivot about said axis, displacing the ribbon between said arms in a generally vertical direction relative to the printhead.

2. A cartridge according to claim 1 wherein said housing includes a mobius for inverting the ribbon.

3. A cartridge according to claim 1 wherein said drive mechanism includes a gear rotatable in response to actuation of said drive mechanism, said cam being coupled to said rotatable gear and rotatable in response to rotation of said rotatable gear.

4. A cartridge according to claim 1 wherein said cam follower includes a member pivotally carried by said housing.

5. A cartridge according to claim 4 wherein said member includes a surface for engagement with the printer whereby said housing is pivotal relative to said member in response to movement of said cam and its engagement with said cam follower.

6. A cartridge according to claim 5 wherein said member is pivotal about an axis spaced from and extending generally parallel to the longitudinally extending oscillatory axis of the housing relative to the printer.

7. A cartridge according to claim 1 wherein said print ribbon drive mechanism carried by said housing includes a drive gear engageable by a ribbon drive carried by the printer, said oscillatory axis of said housing passing through said drive gear at the location of its engagement by the ribbon drive.

8. A cartridge according to claim 1 in combination with said printer, said printer having mountings for receiving said cartridge for pivotal movement and a ribbon drive, said drive mechanism including a gear engageable by said ribbon drive when said cartridge is mounted on said printer, said pivotal mountings for said cartridge being engageable with said connections, respectively, enabling oscillatory movement of said cartridge about said axis.

9. A cartridge according to claim 1 in combination with said printer, said printer having a surface, said cam follower having a portion engageable with said surface enabling said cam follower to lie stationary in said printer and said cartridge to oscillate about said axis.

10. A ribbon cartridge for use with a printer comprising:

a ribbon cartridge housing having spaced ribbon exit and entrance portions and bearing surfaces for mounting said cartridge for oscillatory movement about an axis;

a ribbon disposed in said housing;

a drive mechanism carried by said housing for advancing ribbon from said ribbon cartridge exit portion to said ribbon cartridge entrance portion; and an oscillator mounted on and carried by said housing for oscillating the housing about said axis, said oscillator including a drive mechanism therefor coupled to said ribbon advancing drive mechanism, said oscillator drive mechanism being responsive to actuation of said ribbon advancing drive mechanism to oscillate said housing about said axis, said axis lying generally parallel to the direction of movement of the ribbon between said ribbon cartridge exit portion and said ribbon cartridge entrance portion.

11. A cartridge according to claim 10 in combination with said printer, said printer having a surface, said cam follower having a portion engageable with said surface enabling said cam follower to lie stationary in said printer and said cartridge to oscillate about said axis.

12. A cartridge according to claim 10 wherein said oscillator includes a member pivotally carried by said housing for pivotal movement about an axis generally parallel to said oscillatory axis of said housing and having a surface engageable with the printer.

13. A ribbon cartridge for use with a printer having a printhead, comprising:

a ribbon cartridge housing having spaced ribbon exit and entrance portions and bearing surfaces for mounting said cartridge for oscillatory movement;

a ribbon disposed in said housing;

a drive mechanism carried by said housing for advancing said ribbon in one direction from said ribbon cartridge exit portion to said ribbon cartridge entrance portion;

an oscillator mounted on and carried by said housing for oscillating said housing and said ribbon in a generally vertical direction relative to the printhead, said oscillator including a drive mechanism therefor connected to said ribbon advancing drive mechanism and responsive to actuation of said ribbon advancing drive mechanism to oscillate said housing and said ribbon;

said oscillator further including a cam coupled to said ribbon drive mechanism and movable in response to actuation of said ribbon drive mechanism and a cam follower carried by said housing in following engagement with said cam enabling relative pivotal movement between said housing and said cam follower about an axis generally parallel to said one direction, said cam follower having at least one surface for engagement with the printer whereby movement of said cam and following engagement of said cam follower enables said cartridge to pivot about said axis when said one surface of said cam follower lies in engagement with the printer.

14. A cartridge according to claim 13 wherein said housing includes a mobius for inverting the ribbon.

15. A cartridge according to claim 13 wherein said one direction is a linear direction, said cam being carried by said cartridge for pivotal movement about an axis non-parallel to said one direction, said cam follower and said housing being relatively pivotal about an axis generally parallel to said one direction.

16. A cartridge according to claim 15 wherein said housing is oscillated about an axis generally parallel to said one direction and including a drive gear engageable by a ribbon drive carried by the printer, said oscillatory axis of said housing passing through said drive gear at the location of its engagement by the ribbon drive.

17. A cartridge according to claim 13 in combination with said printer, said printer having a surface, said cam follower having a portion engageable with said surface enabling said cam follower to lie stationary in said printer and said cartridge to oscillate about said axis.

* * * * *